US006732374B1

(12) United States Patent
Blair

(10) Patent No.: US 6,732,374 B1
(45) Date of Patent: May 11, 2004

(54) WEDGE GRIPPER

(76) Inventor: Constance L. Blair, 550 NW. 20th St., Homestead, FL (US) 33030

( * ) Notice: Subject to any disclaimer, the term of this patent is extended or adjusted under 35 U.S.C. 154(b) by 119 days.

(21) Appl. No.: 10/251,730

(22) Filed: Sep. 21, 2002

Related U.S. Application Data

(60) Provisional application No. 60/324,187, filed on Sep. 21, 2001.

(51) Int. Cl.[7] ..... A41D 3/08
(52) U.S. Cl. ..... 2/20
(58) Field of Search ..... 2/20, 21, 17, 161.1, 2/163, 16; 473/59, 61, 201, 212; 482/49

(56) References Cited

U.S. PATENT DOCUMENTS 3,398,951 A * 8/1968 Disko ..... 473/61
3,606,614 A 9/1971 Dimitroff
4,748,690 A 6/1988 Webster
4,892,315 A * 1/1990 Iorlano ..... 473/205
4,977,621 A * 12/1990 Richard ..... 2/161.3
5,214,799 A 6/1993 Fabry
5,806,091 A * 9/1998 McHugh ..... 2/20

* cited by examiner

*Primary Examiner*—Tejash Patel

(57) ABSTRACT

The wedge gripper is a flexible finger held device which protects the fingers while angling or wedging a bar towards or in the palm. The wedge gripper is not limited to a cylindrical excercise bar. It is effective with any cylindrical handle. The wedge gripper's trapezoid ends provide the shape to make it effective. The wedge gripper has a top wider than the parallel bottom and adjacent beveled sides which are the front and the back. The top provides protection of the finger area, pliable tension to the finger against a solid bar, and also is wide enough to create a beveled surface from top to bottom. The bottom creates a pocket for the folds of skin around the finger joints. The front, which is a beveled surface, rests against the solid surface of a bar. The back beveled surface protects the area on the finger from one joint crease to the other joint crease where it is placed. The wedge gripper is placed below the middle finger crease for pulling motions or above the middle crease for pushing motions. The wedge gripper has a strap on the back surface which holds it to the user's fingers.

7 Claims, 4 Drawing Sheets

WEDGE GRIPPER

CROSS-REFEREMCE TO RELATED APPLICATION

This application claims the benefit of Provisional Patent Application Ser. No. 60/324,187 filed Sep. 21, 2001.

FEDERALLY SPONSORED RESEARCH

Not Applicable

SEQUENCE LISTING OR PROGRAM

Not Applicable

BACKGROUND

1. Field of Invention

This invention is a hand gripping accessory used with exercise equipment. The wedge gripper is not limited to a cylindrical excercise bar. It is effective with any cylindrical handle.

2. Description of Prior Art

The wedge gripper solves the problem of not having a continual secure grip. It also creates proper placement of the excercise equipment in the palm securing the grip. Proper placement in the palm, rather than the fingers, minimizes calluses on the palm and the fingers.

Many gloves have been invented to protect a persons hand such as those in U.S. Pat. No. 3,606,614 to Dimitroff (1971) or U.S. Pat. No. 4,748,690 to Webster (1988) or U.S. Pat. No. 5,214,799 to Fabry (1993). However, these gloves do not have the ability to make a cylindrical excercise bar secure in the palm. A cylindrical object will still roll in a persons hand.

In U.S. Pat. No. 5,806,091 to McHugh (1998) the hand grip aid does not prevent calluses on the fingers. It also will not secure a cylindrical excercise bar in the palm. A wedge gripper makes the cylindrical excercise bar secure in the palm. The advantage of the wedge gripper is to make a continuous closure of the fingers to complete a secure grip. When a grip is secure this allows a person to hold fitness equipment stable. When a grip is secure all the muscles in a persons hand, wrist, and forearm are employed in the most effective use. When a secure grip is used the muscles are strengthened enhancing form and endurance.

OBJECTS AND ADVANTAGES

Accordingly, besides the objects and advantages of the wedge gripper described in my above patent, several objects and advantages of the present invention are:

(a) to provide tension to the fingers securing a cylindrical bar in the hand;

(b) to provide an angled surface where the fingers can push the bar towards the palm of the hand;

(c) to provide a surface that will cushion or protect the fingers from the pressure of the solid cylindrical bar;

(d) to provide a flexible surface to the fingers so that the fingers have a constant pliability and tension;

(e) to provide an apparatus that can be worn for pulling as well as pushing movements;

(f) to provide constant pliable tension to the fingers activating the muscles and tendons in the fingers, hand, wrist and forearm;

(g) to provide stability to a grip strengthening the hand, wrist and forearm;

(h) to provide an easily adaptable gripping device with functional strengthening capabilities;

(i) to provide augmentation to a hand that is larger comparatively than the average for a standard cylindrical excercise bar;

(j) to provide a wedge of comfort between a hard steel surface against the skin and bones of the finger;

(k) to provide stability in the hand and lower arm creating maximum effort for maximum effectiveness.

Still further advantages will become apparent from a consideration of the ensuing description and drawings.

SUMMARY

This invention augments a grip by providing continual tension to the fingers. It provides proper placement in the palm eliminating free rotation of a cylindrical bar. The wedge gripper is not limited to a cylindrical excercise bar. It is effective with any cylindrical handle. The wedge gripper minimizes calluses and has a non-slip surface.

DRAWINGS

Drawing Figures

In the drawings, closely related figures have the same number but different alphabetic suffixes.

REFERENCE NUMERALS IN DRAWINGS

Figure 1:
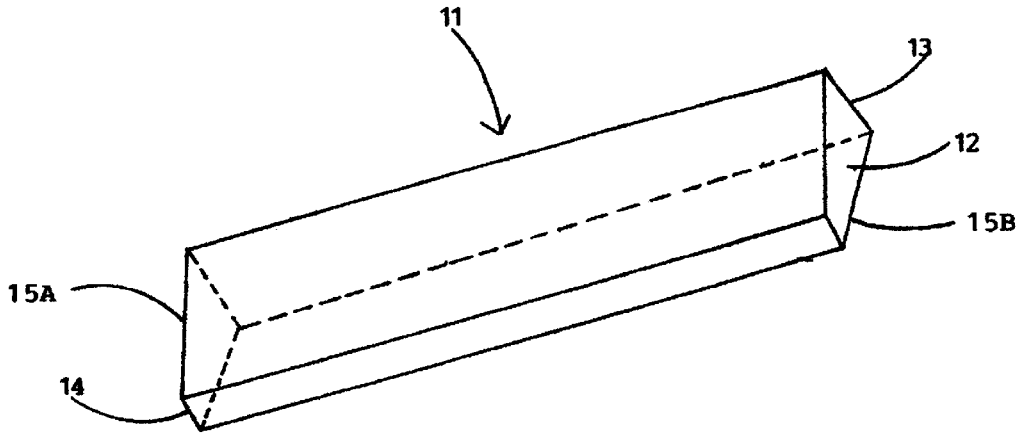
FIG. 1 is a semi-front three dimensional view of my invention showing the shape of all sides.

11 wedge gripper
12 sides of wedge gripper
13 top of wedge gripper
14 bottom of wedge gripper
15A front surface of wedge gripper
15B back surface of wedge gripper with adjustable strap
16 adjustable elastic strap
16A adjustable elastic strap ends embedded in wedge gripper
17 securing anchors for embedded ends of adjustable strap
20 hand palm view
22 hand back view
24 hand side view
26 thumb
28 index finger
30 calluses on the palm
32 calluses on the fingers

DETAILED DESCRIPTION

FIG. 1 is a three dimensional semi-front view of a wedge gripper 11, showing the front surface 15A, the narrow bottom surface 14, and the trapezoid shape side surface 12. The wedge gripper 11 has a preferred embodiment of foam rubber. The trapezoid shaped end 12 is ¾"–1¼" from the top, wide surface 13 to the parallel narrow, bottom surface 14. The width of the top surface of the trapezoid 13 is ½" to 1". The narrow bottom surface 14 is ¼" to ½". The trapezoid shaped end 12 is beleveled at 7°–9° to form the front surface 15A to the back surface 15B.

Figure 2:
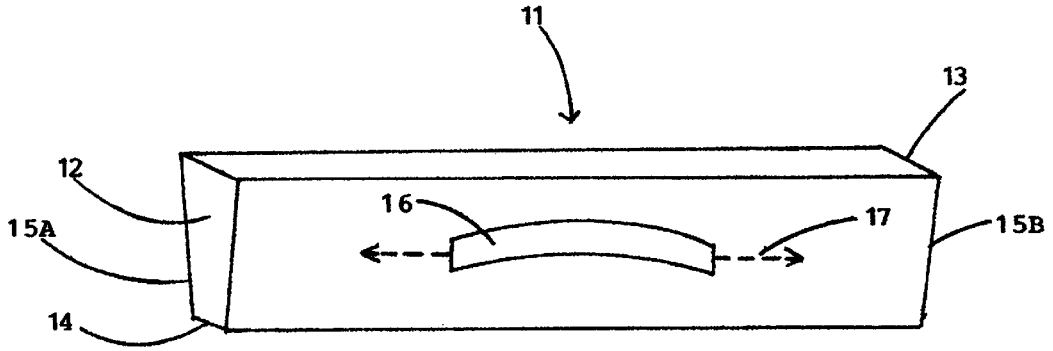
FIG. 2 is a semi-rear view including the adjustable elastic strap.

FIG. 2 is the semi-back view of the wedge gripper 11 showing placement of the adjustable strap 16 one inch to either side of the center. One embodiment of the adjustable strap can be elastic with adjustment mechanism. Another embodiment can be a hook and loop adjustable strap. The adjustable strap is embedded in the foam rubber secured by an anchoring mechanism.

Figure 3:
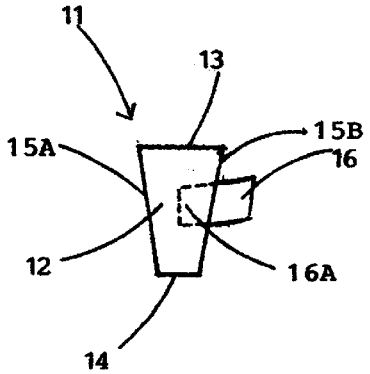
FIG. 3 is a side view showing embedment of adjustable elastic strap.

FIG. 3 is a wedge gripper 11 side trapezoid end view 12 showing the adjustable strap 16 embedment 16A in the wedge gripper 11.

Figure 4A:
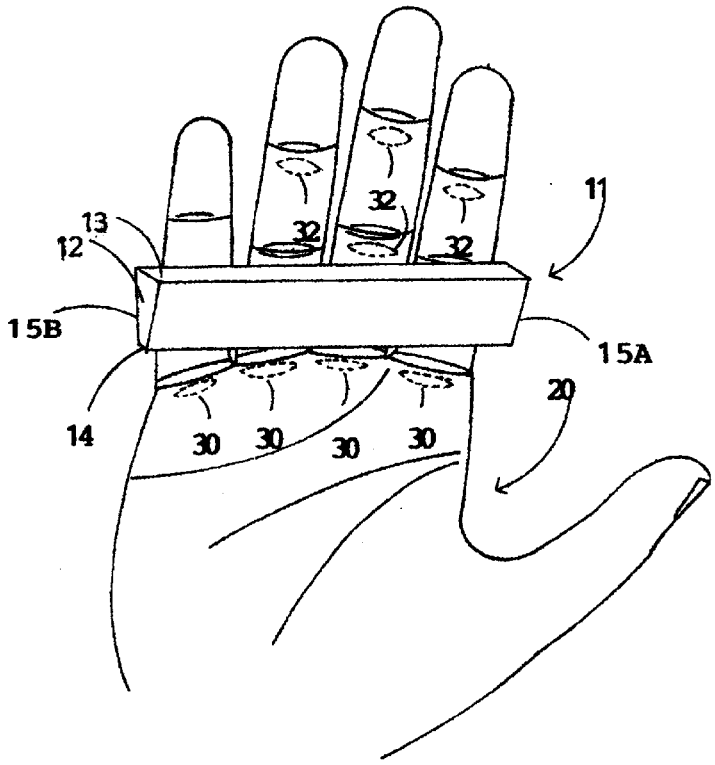
FIG. 4A shows the palm view of the user's hand with the wedge gripper in place for pulling movements.

FIG. 4A is a palm view 20 of the wedge gripper 11 when placed in the user's hand for pulling movements, showing the area where calluses develop on the palm 30 and where calluses develop on the joints of the fingers 32.

Figure 4B:
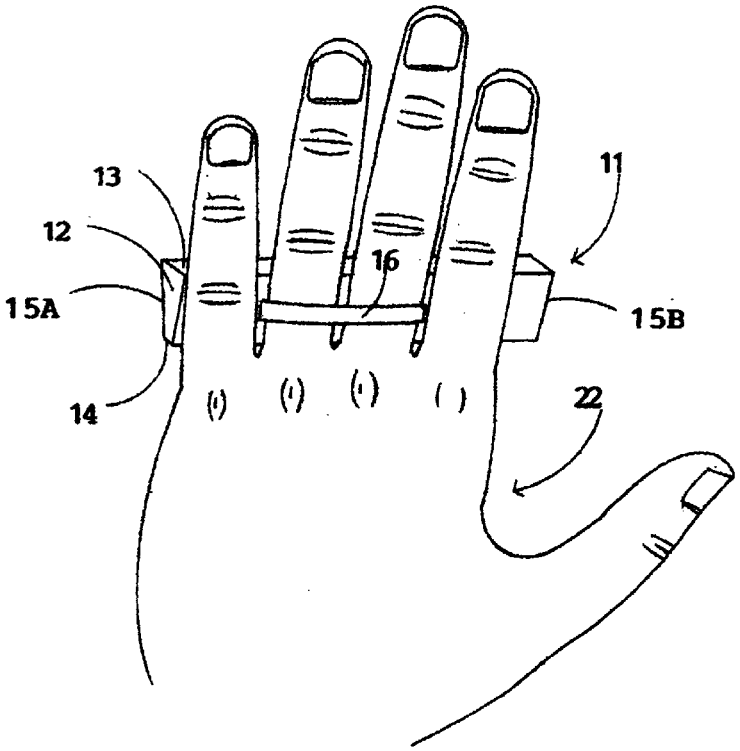
FIG. 4B shows the back side of the user's hand with the strap in view for pulling movements.

FIG. 4B is a hand back view 22 of a user's hand showing the placement of the wedge gripper 11 for pulling motions. It also shows placement of the adjustable elastic strap 16 on a user's fingers for pulling motions.

Figure 5A:
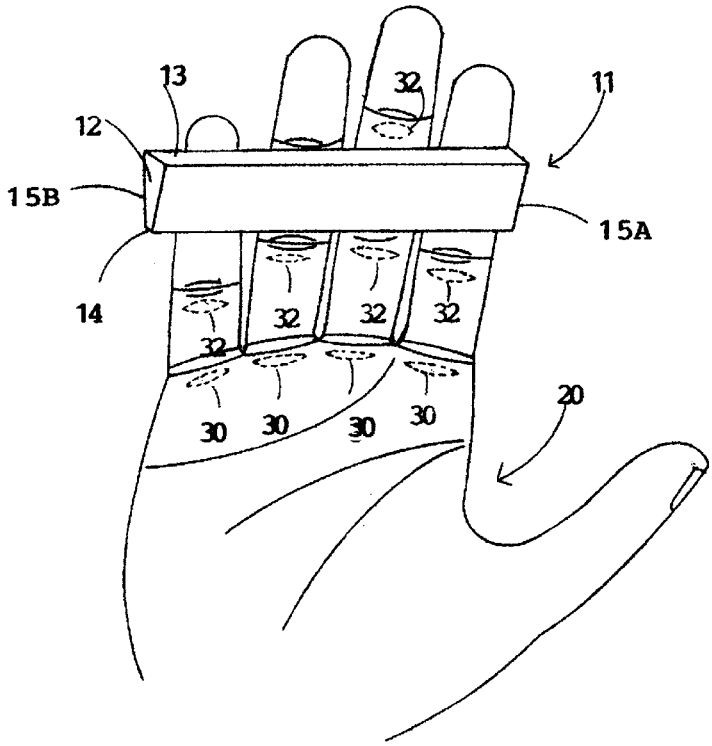
FIG. 5A shows the palm view of the user's hand with the wedge gripper in place for pushing movements.

FIG. 5A is a palm view 20 of the wedge gripper 11 when placed in the user's hand for pushing movements, showing the area where calluses develop on the palm 30 and where calluses develop on the joints of the fingers 32.

Figure 5B:
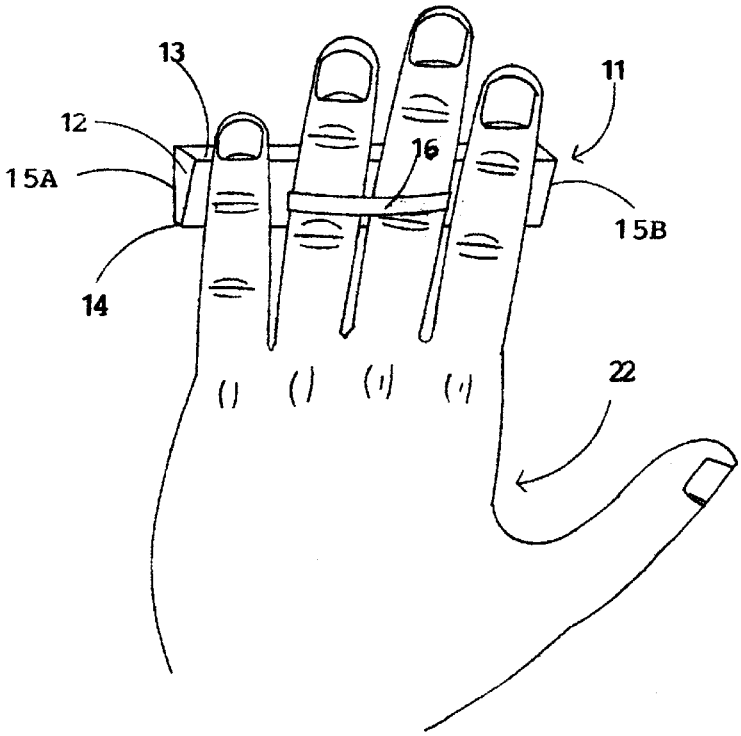
FIG. 5B shows the back side of the user's hand with the strap in view for pushing movements.

FIG. 5B is a hand back view 22 of a user's hand showing the placement of the wedge gripper 11 for pushing motions. It also shows placement of the adjustable elastic strap 16 on a user's fingers for pushing motions.

Figure 6A:
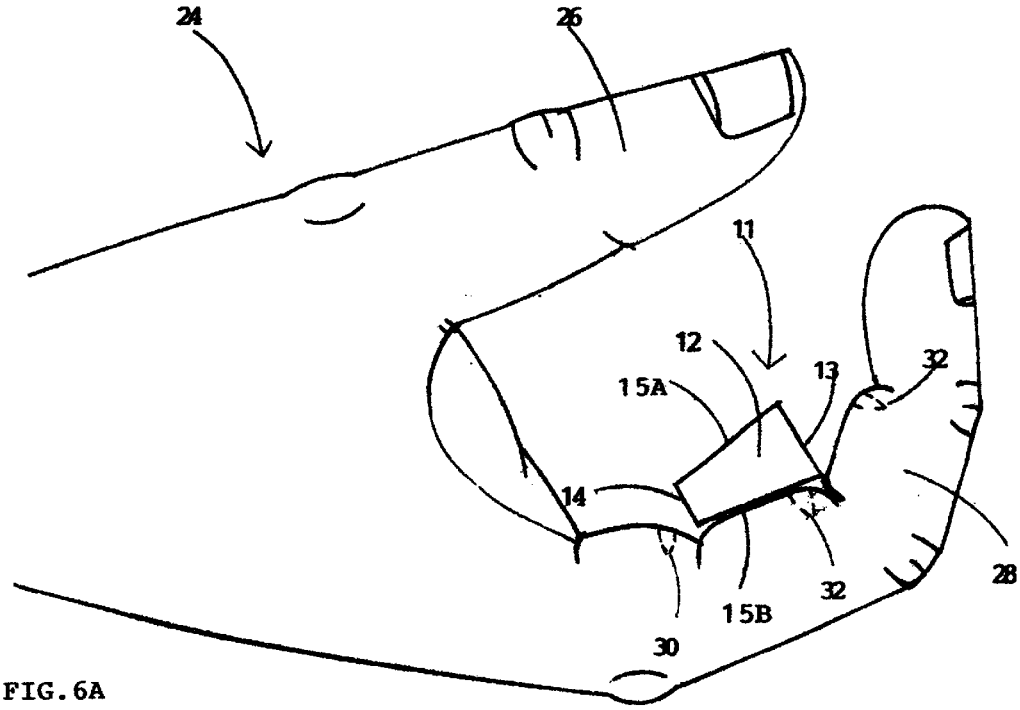
FIG. 6A shows a side view of a user's hand when a grip is initiated for pulling motions.

FIG. 6A is a side of a persons hand 24 showing the thumb 26 and index finger 28 with a wedge gripper 11 placed for pulling motions. The hand side view 24 shows where the calluses on the palm 30 and fingers 32 develop on the fingers 28.

Figure 6B:
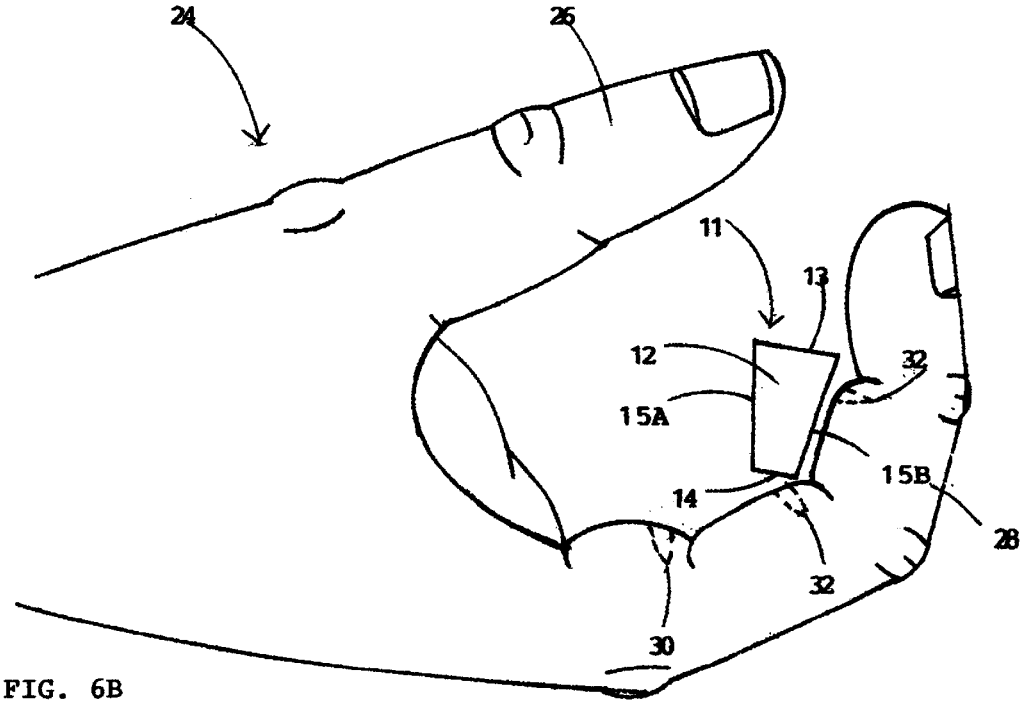
FIG. 6B shows a side view of a user's hand when a grip is initiated for pushing motions.

FIG. 6B is a side of a persons hand 24 showing the thumb 26 and index finger 28 with a wedge gripper 11 placed for pushing motions. The hand side view 24 shows where the calluses on the palm 30 and fingers 32 develop on the fingers 28.

OPERATION

FIG. 1

The wedge gripper 11 in FIG. 1 shows a semi-side 12 view with beveled sides and a trapezoid shape. The top 13 of the trapezoid side 12 is placed on the second joint crease line in a human's fingers for pulling motions. Top 13 can be placed on the first joint crease line toward the tip of the finger for pushing motions. Top 13 is wide enough so that a human's finger can bend over it. Parallel to the top 13 is the bottom 14 which is thinner in width than top 13 and is placed near the third joint crease line for pulling motions. Bottom 14 is also placed near the second joint crease for pushing motions. Bottom 14 has a width that will create a pocket for the folds of skin on a humans finger when the finger is bent. The wedge gripper 11 has a front surface 15A which faces out from the fingers. 15A front is at an angle from top 13 to the bottom 14 to angle a cylindrical bar or handle towards a human's palm area.

FIG. 2

The wedge gripper 11 shows the back 15B comprising a flat surface which is angled from top 13 to bottom 14. Back 15B also shows an adjustable strap 16 which is anchored 17 into the body of the wedge gripper 11. The strap 16 is adjustable to loop around a humans finger or fingers to attach the wedge gripper 11 across the same finger areas as described in FIG. 1.

FIG. 3

The side 12 view shows the top 13, bottom 14, front 15A and back 15B making a trapezoid shape. The side 12 view also shows the strap 16 on the back 15B surface. Side 12 view shows the embedment 16A of strap 16.

FIG. 4A

The wedge gripper 11 is shown placed on a human's fingers for pulling motions. Palm surface of hand 20 shows the area of calluses in the palm 30 which are folded in the pocket of the bottom 14 of the wedge gripper 11. Palm surface of hand 20 also shows calluses on the fingers 32 which are protected by the cushioning of the top 13 of the wedge gripper 11.

FIG. 4B

Back surface of hand 22 shows the placement of the wedge gripper 11 again for pulling motions. Back side of hand 22 also shows the placement of a type of strap 16 looped around the fingers.

FIG. 5A

Palm surface of hand 20 shows wedge gripper 11 placed for pushing motions. Wedge gripper 11 front surface 15A creates a wedge and pliability to the fingers where the wedge gripper 11 is placed. Wedge gripper 11 shows bottom 14. Palm surface of hand 20 shows the area of calluses 32 which are folded in the pocket of the bottom 14 of the wedge gripper 11. Palm surface of hand 20 also shows calluses on the fingers 32 which are protected by the cushioning of the top 13 of the wedge gripper 11.

FIG. 5B

Back surface of hand 22 shows the placement of the wedge gripper 11 again for pushing motions. Back side of hand 22 also shows the placement of a type of strap 16 looped around the fingers.

FIG. 6A

This figure shows a side 24 view of a hand, the thumb, 26 and index finger 28 with a wedge gripper 11 placed for pulling motions. The side 24 view of the hand shows the calluses on the palm 30 being covered by the bottom 14 of the wedge gripper 11. The side 24 view of the hand shows the index finger 28 area where calluses 32 form on the fingers. Side view 24 shows the calluses on the finger 32 being cushioned by the back 15B and the top 13 of the wedge gripper 11. The placement of the wedge gripper 11 side view 12 shows the trapezoid shape where the front 15A is angled to push a cylindrical bar towards the palm area.

FIG. 6B

This figure shows a side 24 view of a hand, the thumb, 26 and index finger 28 with a wedge gripper 11 placed for pushing motions. The side 24 view of the hand shows the calluses of the finger 32 being protected by the back 15B of the wedge gripper 11. The placement of the wedge gripper 11 side view 12 shows the trapezoid shape where the front 15A is angled to push a cylindrical bar towards the palm area.

CONCLUSION, RAMIFICATIONS, AND SCOPE

Thus the reader will see that my invention will provide a new method of preventing calluses on the palm and fingers and proper placement of a cylindrical bar towards or in the palm effectively. The reader will find that the wedge gripper and its finger placement is superior over gloves and wrist straps or other devices worn on the hand or around the wrist.

This invention will provide adequate augmentation to the fingers of a hand when lifting or pushing a cylindrical bar, but not limited to a cylindrical bar, keeping the placement of the cylindrical bar in or towards the palm of the hand. The wedge gripper is effective with any cylindrical handle. The invention will provide augmentation to the grip, by the fingers, on standard sized cylindrical bar. This invention will show that larger hands, with the use of the wedge gripper, comparatively to the standard sized cylindrical bar, will reduce free rotation of the standard cylindrical bar from the palm area outwardly to the fingers. If a hand and fingers are not proportionate to the diameter of the bar it will not be kept in place effectively, causing outwardly free rotation (rolling), pinching of the skin at the joints causing callusing, and lead to an ineffective grip. The ineffectiveness of a grip will not only cause calluses but will also leave the muscles and tendons of the hand, wrist and forearm utilized at less than 100% to stabalize the bar being gripped. My invention will not only provide tension at the base of the fingers for placement of a bar in the palm for pulling motions, it is also adjustable to be placed in the middle of the fingers providing tension and placement of the bar, for pushing motions.

My invention's, preferred embodiment from the side view, has a trapezoid shape. The trapezoid shape of the wedge gripper is the most effective. It is measured from the narrow bottom side to the parallel top side at ¾", 1" and 1¼" to cover the surface of a finger from joint crease line to joint crease line. The beveled sides of the preferred trapezoid shape creates the angles in which to wedge or push the cylindrical bar towards or in the palm. The length of the wedge gripper in its preferred embodiment is between 4"and 4½" to cover the width of all the fingers but yet may fit between the weights of a dumbell excercise bar.

The wedge gripper's preferred body is of a non-slip foam rubber with a predetermined density to create pliabiity yet density for finger protection.

The wedge gripper in its preferred embodiment has an adjustable strap or retaining device to loop around the back of the fingers of the user's hand. The wedge gripper in this embodiment is preferred whereby it may be placed at the base of the fingers or in the middle of the fingers.

Although the description above contains many specificities, these should not be construed as limiting the scope of the invention but as merely providing illustrations of some of the presently preferred embodiments of this invention. For example, the side view may have a rectangular shape or a three 90° adjacent sided and one beveled sided shape.

The material of the wedge gripper is preferred to be foam rubber for non-slip purposes. It also may be made of other resilient materials having a core and an outer surface such as foam, foam rubber, or sponge core with a laytex outer cover. The wedge gripper or the outer body of the wedge gripper may be various colors.

The adjustable strap is preferred to be elastic with a sliding adjustable mechanism. It may also be made of a stretchable material with or without an adjustable mechanism. A third retaining strap may be of a hook and loop material when attached to each other becomes strapped around the fingers.

The embedment of the strap into the body of the wedge gripper is preferred anchored by a plastic anchor or keeping device and glue. Alternatives to this preferred embedment to foam rubber may vary by the core material used.

Thus the scope of the invention should be determined by the appended claims and their legal equivalents, rather than by the examples given.

What is claimed is:

1. A finger grip apparatus to be used with resistance and weight bearing equipment, comprising:

a resilient elongated body having a bottom surface with approximately width of ¼" to ½", a top surface being parallel with the bottom surface that has a width of ½" to 1", the body has equally shaped trapezoid ends with approximately height of ¾" to 1¼", said body has a length of approximately 4" to 5"; and said body to be placed lengthwise across a human's fingers on the palm side between the first and second joint crease lines; and a retainer attached to one side of said body to be worn on user's middle and ring fingers; and said retainer comprising an adjustable hook and loop fastener to retain said body to the middle and ring fingers.

2. The finger grip apparatus of claim 1, wherein said body is of a foam rubber.

3. The finger grip apparatus in claim 1, wherein said body is configured to cover the area lengthwise across a human's fingers between the second and third joint crease line.

4. The finger grip apparatus of claim 1, wherein said body has a non-slip outer surface.

5. The body of claim 4 wherein said non-slip surface is a flexible resilient material having a plurality of colors and a plurality of symbols on its surface.

6. The non-slip outer surface of claim 5 wherein said flexible resilient material is a foam, a foam rubber, or a latex material.

7. The finger grip apparatus of claim 1, wherein said retainer having a plurality of colors and a plurality of symbols on its surface.

* * * * *